US008436597B2

(12) United States Patent
Sicard

(10) Patent No.: US 8,436,597 B2
(45) Date of Patent: May 7, 2013

(54) VOLTAGE REGULATOR WITH AN EMITTER FOLLOWER DIFFERENTIAL AMPLIFIER

(75) Inventor: Thierry Sicard, Tournefeuille (FR)

(73) Assignee: Freescale Semiconductor, Inc., Austin, TX (US)

( * ) Notice: Subject to any disclaimer, the term of this patent is extended or adjusted under 35 U.S.C. 154(b) by 254 days.

(21) Appl. No.: 12/863,678

(22) PCT Filed: Feb. 4, 2008

(86) PCT No.: PCT/IB2008/051769

§ 371 (c)(1),
(2), (4) Date: Jul. 20, 2010

(87) PCT Pub. No.: WO2009/098545

PCT Pub. Date: Aug. 13, 2009

(65) Prior Publication Data

US 2010/0295524 A1 Nov. 25, 2010

(51) Int. Cl.
*G05F 1/575* (2006.01)

(52) U.S. Cl.
USPC ..... 323/280; 323/273

(58) Field of Classification Search ..... 323/273, 323/280
See application file for complete search history.

(56) References Cited

U.S. PATENT DOCUMENTS

| | | | | |
|---|---|---|---|---|
| 5,714,872 | A * | 2/1998 | Heimerl et al. | 323/273 |
| 5,909,109 | A | 6/1999 | Phillips | |
| 6,373,233 | B2 | 4/2002 | Bakker et al. | |
| 6,842,068 | B2 * | 1/2005 | Perrier et al. | 327/540 |
| 7,235,959 | B2 | 6/2007 | Sicard | |
| 2003/0111986 | A1 * | 6/2003 | Xi | 323/280 |
| 2003/0235058 | A1 | 12/2003 | Toyoshima et al. | |
| 2004/0164789 | A1 | 8/2004 | Leung et al. | |
| 2008/0157735 | A1 * | 7/2008 | Liu et al. | 323/280 |

FOREIGN PATENT DOCUMENTS

JP 2006318204 A 11/2006

OTHER PUBLICATIONS

Heisley Dave et al: "DMOS Delivers Dramatic Performance Gains to LDO Regulators" Texas Instruments, Dallas, TX, www.ednmag.com, Jun. 22, 200, pp. 141-150.

Philips Semiconductors: "CapFREE 150 mA, Low-Noise, Low Dropout Regulator with Thermal Protection" Product Data SA57000-XX, USA, www.semiconductors.philips.com, Jul. 30, 2003, pp. 1-15.

Analog Devices: "High Accuracy Ultralow Iq, 200 mA, SOT-23, anyCAP Low Dropout Regulator" Product Data ADP3330, Norwood, MA, USA, www.analog.com, 1999, pp. 1-12.

(Continued)

*Primary Examiner* — Adolf Berhane
*Assistant Examiner* — Fred E Finch, III

(57) ABSTRACT

A low drop-out DC voltage regulator comprising an output pass element for controlling an output voltage (v) of power supplied from a power supply through the output pass element to a load (R), a source of a reference voltage (v), and a feedback loop for providing to the output pass element a control signal tending to correct error in the output voltage. The feedback loop includes a differential module responsive to relative values of the output voltage (v) and the reference voltage (v) and an intermediate module driven by the differential module for providing the control signal. The differential module presents the widest bandwidth of the modules of the regulator and the differential module presents a frequency pole that is higher than the cut-off frequency of the regulator, at which its regulation gain becomes less than one.

20 Claims, 6 Drawing Sheets

OTHER PUBLICATIONS

MICREL: "Ultra-Low Quiescent Current, 150 mA, uCap LDO Regulator" Product Data MIC5235, San Jose, CA, USA, www.micrel.com, Jan. 2002, pp. 1-10.

International Search Report and Written Opinion correlating to PCT/IB2008/051769 dated Oct. 8, 2008.

* cited by examiner

VOLTAGE REGULATOR WITH AN EMITTER FOLLOWER DIFFERENTIAL AMPLIFIER

FIELD OF THE INVENTION

This invention relates to low drop-out (LDO) DC voltage regulators.

BACKGROUND OF THE INVENTION

A low drop-out DC voltage regulator is a regulator circuit that provides a controlled and stable DC voltage relative to a reference voltage. The operation of the circuit is based on feeding back an amplified error signal which is used to control output current flow of a pass device, such as a power field-effect transistor ('FET') driving a load. The drop-out voltage is the difference between the supply voltage and the output voltage below which regulation is lost. The minimum voltage drop required across the LDO regulator to maintain regulation is just the voltage across the pass device.

The low drop-out nature of the regulator makes it appropriate (over other types of regulators such as DC-DC converters and switching regulators) for use in many applications such as automotive, portable, and industrial applications. In the automotive industry, the low drop-out voltage is necessary for example during cold-crank conditions where an automobile's battery voltage can be below 6V. LDO voltage regulators are also widely used in mobile products with battery power supplies (such as cellular phones, personal digital assistants, cameras and laptop computers), where the LDO voltage regulator typically needs to regulate under low supply voltage conditions.

The main components of a simple LDO DC linear voltage regulator are a power amplifier such as an FET forming the pass device and a differential amplifier (error amplifier). One input of the differential amplifier monitors a percentage of the output, as determined for example by the ratio of a resistive voltage divider across the output. The second input to the differential amplifier is from a stable voltage reference (such as a bandgap reference voltage source). If the output voltage rises too high relative to the reference voltage, the drive to the power FET changes so as to maintain a constant output voltage. These elements constitute a DC regulation loop which provides voltage regulation.

In a typical LDO voltage regulator, the first stage (the error amplifier) presents a high impedance node. This high impedance node creates a frequency pole. The power amplifier, the output (including the load) and the first stage pole would give instability, which is avoided by using the output pole as the dominant pole to get stability. Generally this type of driver is still unstable when the load capacitance is 0. Accordingly, the output capacitance has to be specified, as does a minimum and maximum Equivalent Series Resistance ('ESR'). As the load is part of the regulation loop, it is still possible for instability to be caused by such indeterminate factors as parasitic capacitance.

U.S. Pat. No. 6,373,233 describes a LDO voltage regulator including a capacitor connected in a compensation circuit element between control and output terminals of an output transistor. The voltage characteristics of the capacitor must be compatible with the usage specification and for a high voltage application, such as a 40 volt maximum output voltage, for example, the capacitor cannot be integrated in the manufacturing process of the voltage regulator using some metal-oxide-Silicon manufacturing techniques.

Transient load regulation is another important parameter of a LDO voltage regulator but U.S. Pat. No. 6,373,233 gives no information on how adequate performance in this respect could be achieved.

SUMMARY OF THE INVENTION

The present invention provides a low drop-out DC voltage regulator as described in the accompanying claims.

DETAILED DESCRIPTION OF THE PREFERRED EMBODIMENTS

Figure 1:
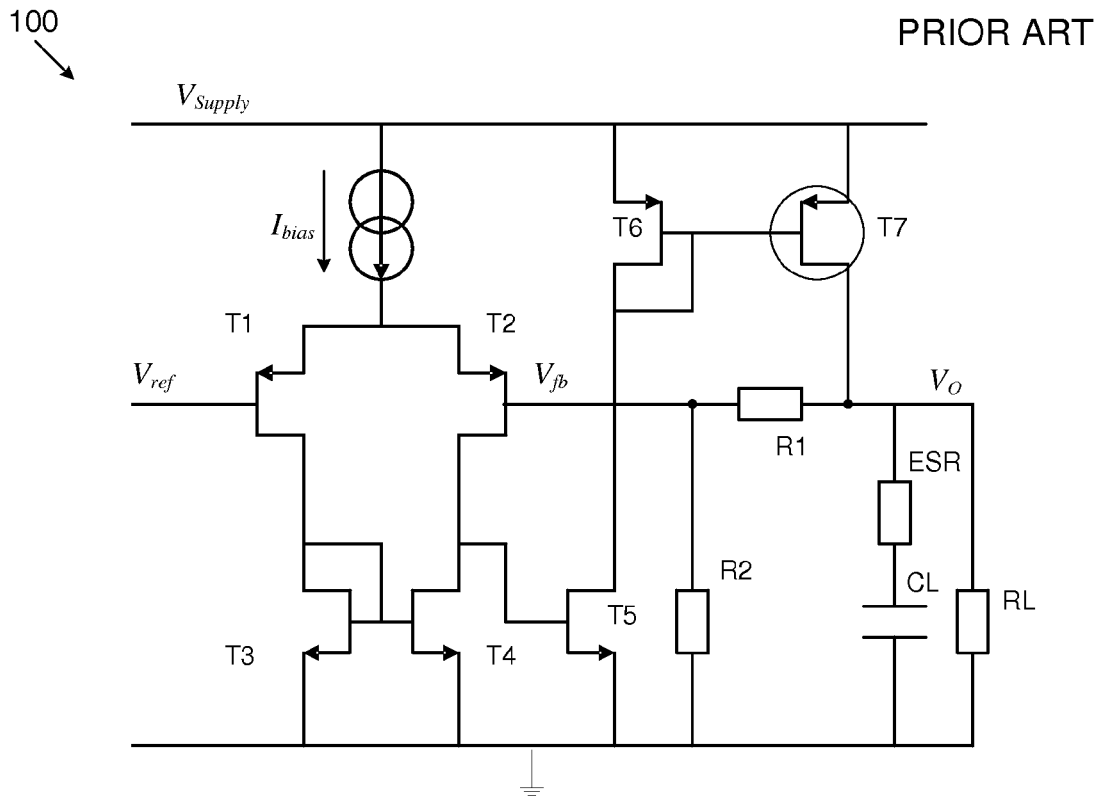
FIG. 1 is a schematic circuit diagram of a known low drop-out DC voltage regulator.

FIG. 1 shows a known LDO voltage regulator 100 powered by a voltage $V_{supply}$ from a power supply (not shown) such as a battery, and which comprises a differential field effect transistor (TED pair module T1-T4, receiving a reference voltage $v_{ref}$ from a source (not shown) such as a bandgap circuit on one input and a feedback voltage $v_{fb}$, on another input. The differential transistor pair module T1-T4 provides an output corresponding to the difference between the reference voltage $v_{ref}$ and the feedback voltage $v_{fb}$, to an intermediate buffer stage comprising FETs T5-T6 in series between the supply voltage $v_{supply}$ and ground, the buffer stage driving an FET pass device T7 coupled to a load comprising in parallel a resistive component RL and a capacitor CL having an equivalent series resistance ESR. The output voltage is applied to a voltage divider comprising resistors R1 and R2, which generate the feedback voltage $v_{fb}$ with a proportionality that may be varied to choose the relation between the regulated output voltage and the reference voltage. These elements constitute a DC regulation loop which provides low drop-out voltage regulation.

Figure 2:
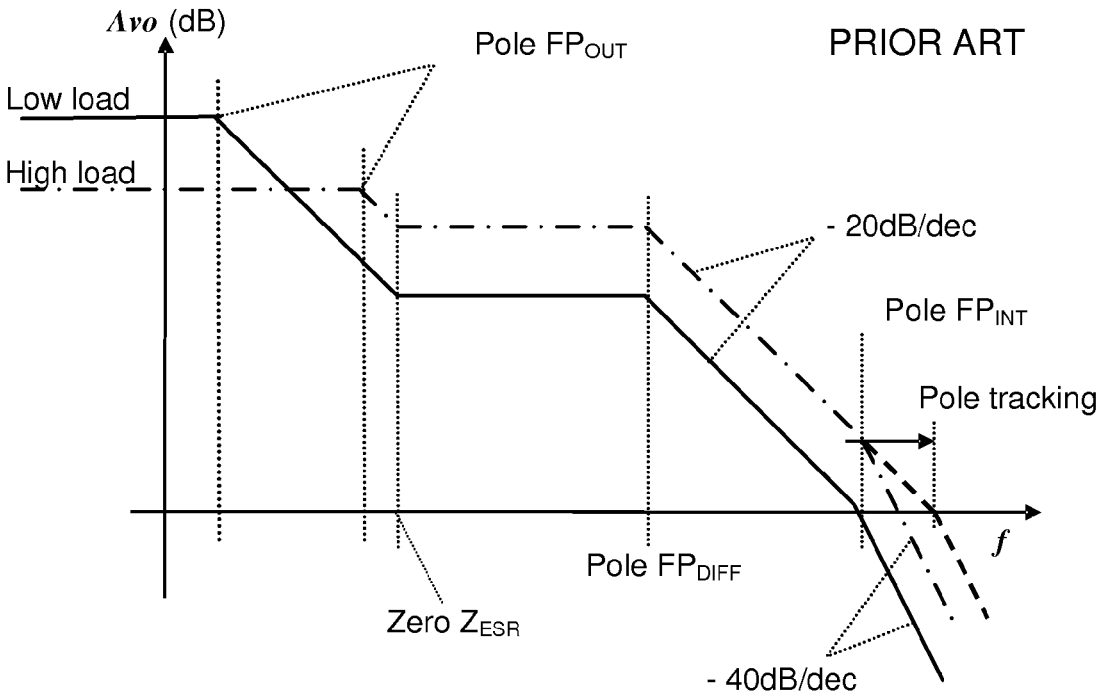
FIG. 2 is a graph of voltage gain against frequency for the LDO regulator of FIG. 1.

FIG. 2 shows the open loop gain Avo of the voltage regulation loop, that is to say the gain $V_O/V_{fb}$, with $V_{ref}$ fixed (DC voltage) and the feedback loop opened between the gate of T2 and the common point between R1 and R2, as a function of frequency f. The system has a dominant low frequency pole $FP_{OUT}$ created by the output capacitance CL, a zero $Z_{ESR}$ created by the ESR of the output capacitance CL, a further sub-dominant pole $FP_{DIFF}$ created by the differential pair module T1-T4 and a further sub-dominant pole $FP_{INT}$ created by the intermediate buffer stage T5-T6. The dominant low frequency pole $FP_{OUT}$ created by the output capacitance CL is at a frequency much lower than the cut-off frequency at which the regulation gain of the regulator becomes less than one (zero dB).

It will be understood that the use in the intermediate buffer stage of device T5 alone produces the plot shown in full and chain-dotted lines in FIG. 2, and that the use additionally of device T6 allows the pole $FP_{OUT}$ to track the displacement of the pole $FP_{OUT}$ as shown by the dashed line in the drawing. The open loop DC gain of the output stage varies as a function of output current since it is proportional to:

$$g_{m7} \cdot (r_{DS7} // R_L) \propto \frac{1}{\sqrt{I_L}} \quad \text{Equation 1}$$

where $g_{m7}$ is the transconductance of the pass device T7 itself, $r_{DS7}$ is the output resistance presented by the pass device T7 with the voltage divider R1-R2 and $(r_{DS7}//R_L)$ is the resistance presented by the parallel combination of the resistances $r_{DS7}$ and $R_L$.

The frequency of the pole of the output stage is given by:

$$f_{OUT} = \frac{1}{2\pi C_L (r_{DS7} // R_L)} \quad \text{Equation 2}$$

and also varies as a function of output current since:

$$r_{DS7} // R_L \propto \frac{1}{I_L} \quad \text{Equation 3}$$

It follows that an increase in the load current results in the pole frequencies of the output and buffer stages increasing faster with output current than the gain diminishes, resulting in more gain at higher frequencies before reaching the cut-off frequency of the regulator.

The output pass device T7 is a PMOS FET, which allows a regulated low drop-out voltage to be obtained between supply and output voltages, but since the output is made with the drain of the PMOS device T7, the output is high impedance and the load and hence the load capacitor are part of the loop. Since the load capacitance CL appears in the main loop of the regulator, a strict specification is imposed on its value and on its ESR, which may still require the use of a large external bypass external capacitor in addition in order to ensure the stability of the loop.

Figure 3:
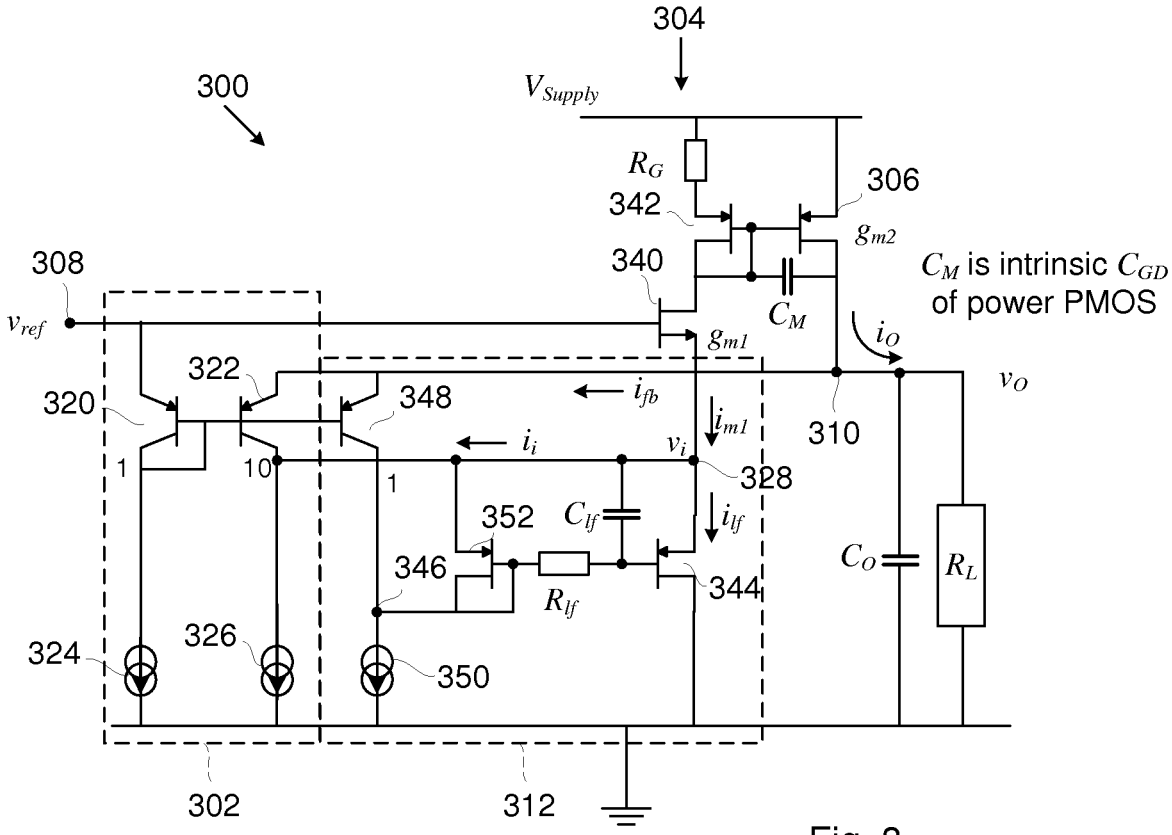
FIG. 3 is a schematic circuit diagram of a low drop-out DC voltage regulator in accordance with one embodiment of the invention, given by way of example.

FIG. 3 shows a low drop-out DC voltage regulator 300 in accordance with an embodiment of the present invention, given by way of example, which is stable independently of the load capacitance and whose use is not limited to a range of minimum and maximum load ESR, especially for high voltage applications, but also for other applications.

The low drop-out DC voltage regulator 300 is powered by a voltage $v_{supply}$ from a power supply (not shown) such as a battery, and which comprises a differential amplifier module 302, an intermediate buffer stage 304, and an output FET pass device 306. The differential amplifier module 302 receives a reference voltage $v_{ref}$ at an input terminal 308 from a source (not shown) such as a bandgap circuit on one input and a feedback voltage on another input equal to the output voltage $v_O$ appearing at an output terminal 310. The load, shown as comprising a resistive component $R_L$ and a capacitive component $C_O$, is connected between the output terminal 310 and ground. The differential amplifier module 302 and the intermediate buffer stage 304 form a feedback loop for providing to the output FET pass device 306 a control signal tending to correct error in the output voltage. A frequency and phase compensation module 312 between the differential amplifier input stage 302 and the intermediate buffer stage 304 provides gain and phase compensation as a function of frequency.

In more detail, the differential amplifier input stage 302 comprises pnp transistors 320 and 322 connected with common bases. The transistor 322 is arranged to have a current-carrying capacity substantially greater than the transistor 320. In this example, it is ten times greater than the transistor 320 but in other embodiments of the invention the current-carrying capacity of the transistor 322 is between five and fifteen times the current-carrying capacity of the transistor 320. The emitter of the transistor 320 is connected to receive the reference voltage $v_{ref}$ from the input terminal 308 and its collector is connected to its base and through a current source 324 to ground. The emitter of the transistor 322 is connected to receive the feedback voltage $v_O$ from the output terminal 310 and its collector is connected through a current source 326 to ground and to a node 328 in the buffer stage 304.

The output pass device 306 is a p-type power FET, which has its source connected to receive the voltage $v_{supply}$ from the power supply and its drain connected to the output terminal 310. The only significant capacitive element $C_M$ presented by the regulator 300 at the output terminal 310 is constituted by the intrinsic gate-drain capacitance $C_{GD}$ of the FET 306 itself. No external capacitance is utilised and would be unnecessary for the stable functioning of the regulator.

The buffer stage 312 comprises an n-type FET 340, whose source is connected to the node 328, whose gate is connected to the reference terminal 308 and whose drain is connected to the gate of the output pass FET 306. Pole tracking is provided by a p-type FET 342, whose source is connected to receive the voltage $V_{supply}$ from the power supply through a resistor $R_G$, whose drain is connected to the drain of the FET 340 and whose gate is connected to the gate of the output pass FET 306 and to the drain of the FET 340.

The frequency and phase compensation module 312 comprises a p-type FET 344 whose source is connected to the node 328, whose drain is connected to ground and whose gate is connected through a capacitor $C_{lf}$ to the node 328 and through a resistor $R_{lf}$ to a node 346. The node 346 is connected to the collector of a pnp transistor 348, whose emitter is connected to the output terminal 310 and which has its base connected in common with the transistors 318 and 320. The node 346 is also connected through a current source 350 to ground and to the drain and gate of a p-type FET 352, whose source is connected to the output terminal 310.

In operation, ignoring initially the effect of the frequency and phase compensation module 312, the transistor 320 establishes across the current source 324 a voltage equal to reference voltage $v_{ref}$ diminished by a small voltage drop between the emitter and collector of the transistor 320 and applies the same voltage to the base of the transistor 322. The transistor 322 establishes across the current source 326 an error voltage $v_i$ proportional to output voltage $v_O$ diminished by a voltage drop between the emitter and collector of the transistor 322 and applies the same voltage to the node 328, the voltage drop across the emitter and collector path of the transistor 322 being a function of the difference between the output voltage $v_O$ and the voltage at the collector of the transistor 320. Normally, the output voltage $v_O$ applied to the emitter of the transistor 322 (and the emitter of the transistor 348 when the frequency and phase compensation module 312 is added) will be slightly less than the reference voltage $v_{ref}$ and the gate-source voltage applied to the FET 340 by the terminal 308 and the node 328 will cause the FETs 340 and 342 of the buffer stage to conduct a current $i_{m1}$ that is a function of the difference between the output voltage $v_O$ and the reference voltage $v_{ref}$ and of the resistor $R_G$, with a transconductance of the buffer stage of $g_{m1}$. The corresponding voltage applied to the gate of the pass FET 306 is a control signal tending to cause the FET 306 to correct error in the output voltage $v_O$ with a transconductance of $g_{m2}$.

The differential module 302 (with the transistor 348), and hence the output 310 present low impedances to the feedback current $i_{fb}$, whose values in this embodiment of the invention are of the order of 260 ohms for a bias current of 100 μA, for example, and the low impedance of this emitter-follower stage is in parallel with the drain of the FET 306. The differential module 302 presents the widest bandwidth of the modules of the regulator and the differential module 302 presents a frequency pole that is higher than the cut-off frequency of the regulator because the frequency pole of the differential module 302 is inversely proportional only to the parasitic capacitance at this stage. In a specific implementation of the regulator of FIG. 3, the resistance $r_L$ presented to the output terminal 310 by the regulator was 140 ohms, the DC gain (at 0 Hertz) with a power supply current of 200 mA was 63 dB for high load resistance and 48 dB for load resistance $R_L$ of 25 ohms. The cut-off frequency was 20 MHz. The frequency pole of the differential module 302 was higher than the cut-off frequency and would have been over 30 MHz. More generally, the closed loop gain of the regulator is given by:

$$v_O / v_i = g_{m1} R_G g_{m2} (R_L // r_L) \cdot \frac{g_{m1}}{jC_M \omega} \qquad \text{Equation 4}$$

where $v_i$ is the voltage at the node 328. This gain is higher the lower the resistance $r_L$ and the capacitance $C_M$ presented to the output terminal 310 by the regulator. In this embodiment of the invention, the capacitance $C_M$ is reduced to the intrinsic gate-drain capacitance $C_{GD}$ of the FET 306 itself.

The DC gain is $v_O/v_i = g_{m1} R_G g_{m2} (R_L // r_L)$ and the difference between the DC gains at high load impedance and at low (25 ohm) load impedance is only 15 dB in the implementation example referred to above.

Figure 4:
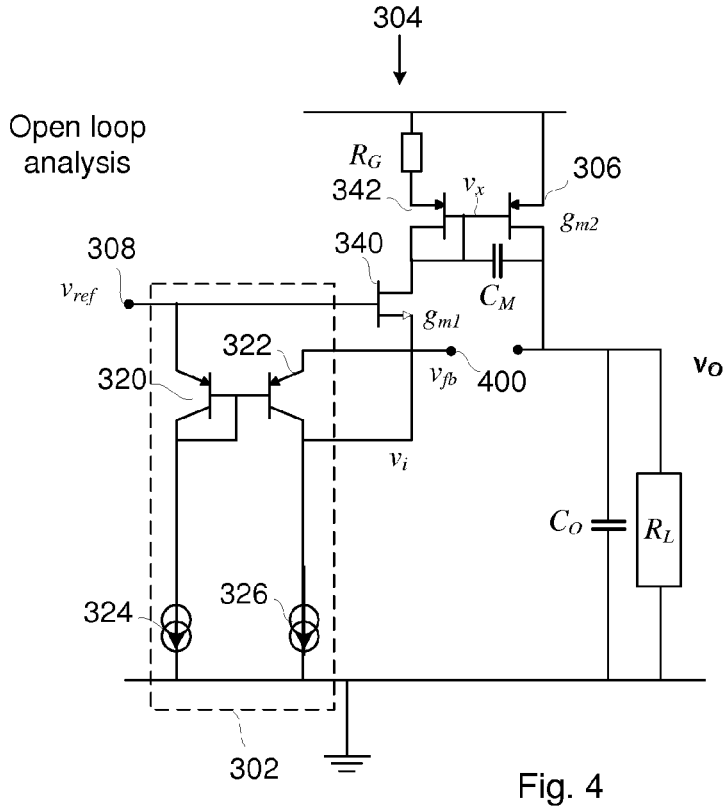
FIG. 4 is a representation of a configuration of the LDO regulator of FIG. 3 for the purposes of open feedback loop analysis, without a frequency and phase compensation module.
Figure 5:
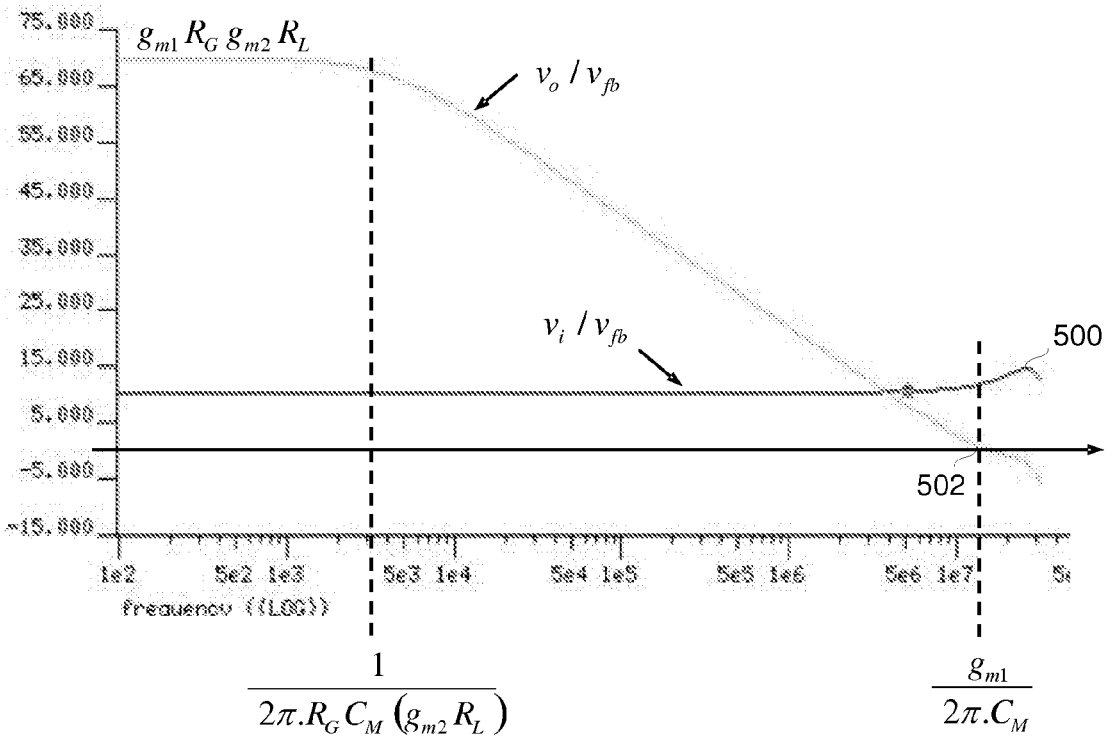
FIG. 5 is a graph of open-loop voltage gain against frequency for the LDO regulator configuration of FIG. 5.

FIG. 4 represents a theoretical configuration of the regulator of FIG. 3 for open-loop analysis, with an interruption in the feedback loop between the output terminal 310 and an input 400 for the differential amplifier input stage 302, the frequency and phase compensation module 312 being omitted initially. FIG. 5 shows the overall open loop gain $v_O/v_{fb}$, of the regulator for the implementation referred to above, where $v_{fb}$ is the voltage at the input 400, and the curve $v_i/v_{fb}$, shows that the frequency pole 500 of the differential amplifier module 302 does not appear before a frequency over 30 MHz, higher than the cut-off frequency 502 at $$\frac{g_{m1}}{2\pi \cdot C_M},$$

which is 20 MHz in this implementation.

Figure 6:
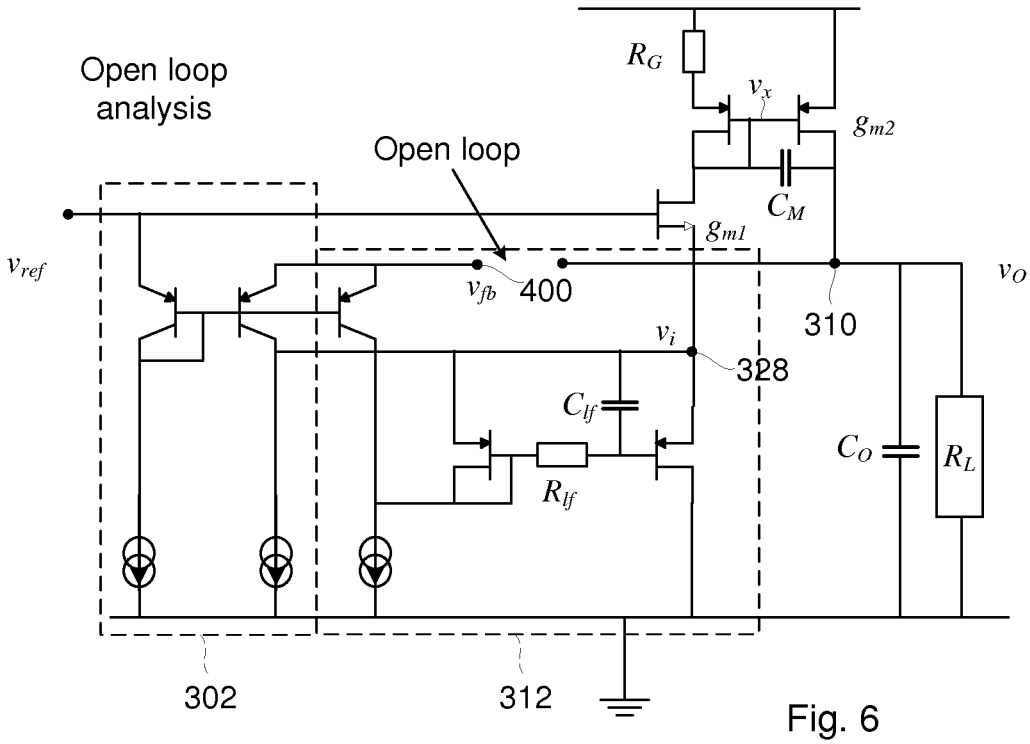
FIG. 6 is a representation of a configuration of the LDO regulator of FIG. 3, with the frequency and phase compensation module, for the purposes of open feedback loop analysis.
Figure 7:
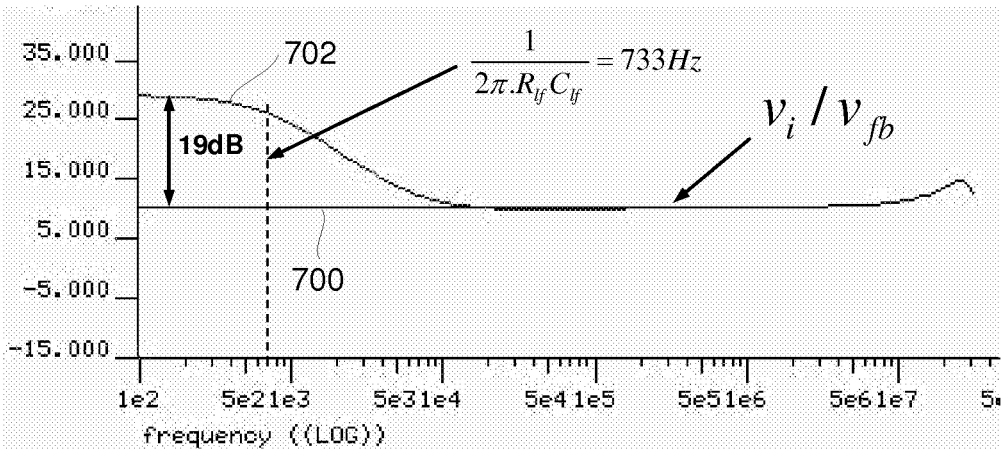
FIG. 7 shows graphs of open-loop voltage gain against frequency for the LDO regulator of FIGS. 4 and 6 by way of comparison.

An effect of the addition of the frequency and phase compensation module 312 is illustrated by comparison with FIG. 6, which is a theoretical open loop configuration of the regulator similar to FIG. 4 but including the frequency and phase compensation module 312. FIG. 7 shows the open loop gain $v_i/v_{fb}$, of the differential amplifier input stage 302 alone in curve 700 and with the phase compensation module 312 included in curve 702. It will be seen that without the phase compensation module 312 the gain of the stages is 10 dB in the implementation referred to above, substantially independent of frequency until the frequency pole, at over 30 MHz. In the phase compensation module 312, the FET 344 is part of a current amplifier, driven by the transistor 348, which has a current carrying area $1/10^{th}$ of the transistor 322 in this example, and by the FET 352 through the resistance $R_{if}$. At low frequencies, below 733 Hz for example, the phase compensation module 312 increases the gain $v_i/v_{fb}$, of the two stages to nearly 30 dB but the gain reduces to 10 dB at higher frequencies, due to the capacitor $C_{if}$ between the gate and source of the FET 344. The high frequency gain is sufficient to drive the maximum transient output current in the load $R_L$.

Analysis shows that the LDO regulator 300 is stable whatever the values of the load resistance and capacitance, as measured by the phase margin, that is to say the margin from a phase shift in the regulator loop of 180° at which the feedback would be positive instead of negative and oscillation would occur. When the load capacitance $C_O$ is large, for example 100 μF, the dominant pole is given by $C_O$ and the phase margin for the implementation referred to above is 85°, so that the regulator is stable.

Figure 8:
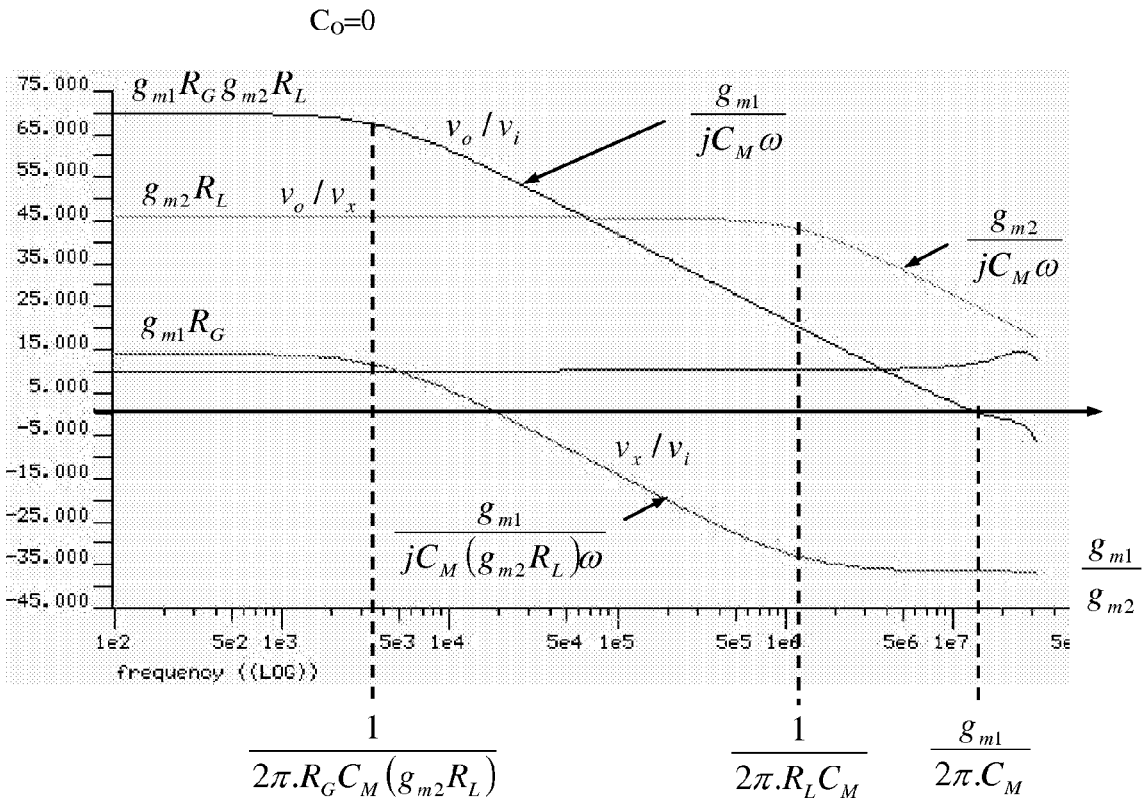
FIGS. 8 and 9 show graphs of open-loop voltage gain against frequency for the LDO regulator of FIG. 5 for two different load capacitances.

As shown in FIG. 8, when the load capacitance $C_O$ is zero, the dominant pole is internal to the regulator and the phase margin for the implementation referred to above is 31°.

Figure 9:
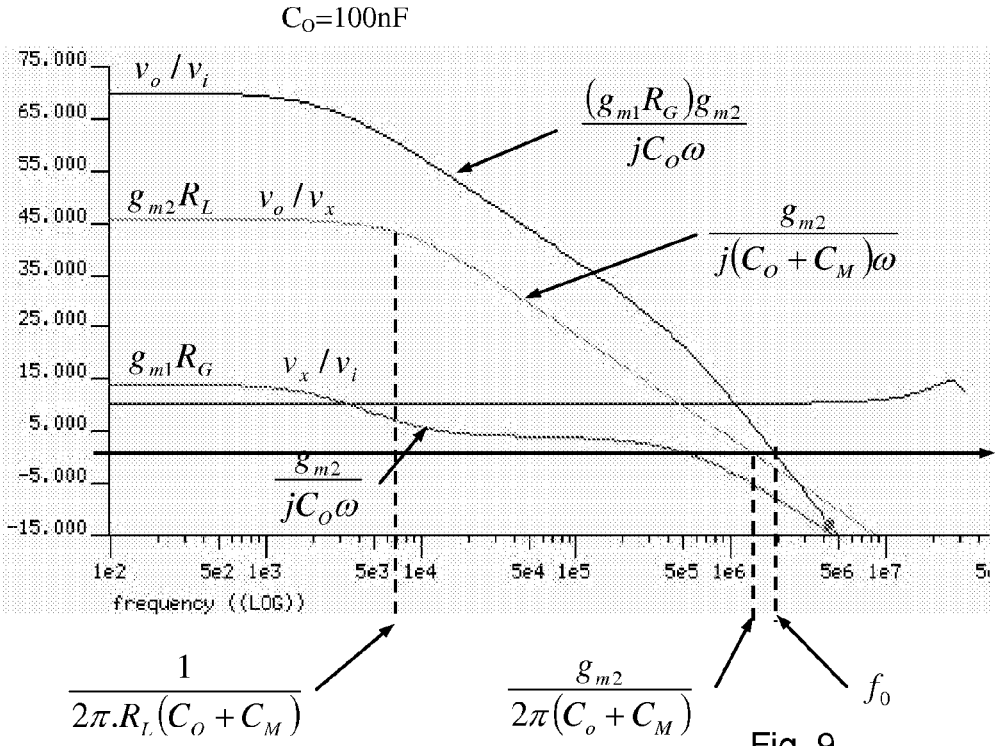

Analysis shows that, for the implementation referred to above, the worst case occurs for a value of the load capacitance $C_O$ of 100 nF, which is shown in FIG. 9, and for which the phase margin is 12°, which is still sufficient to ensure stability.

Analysis also shows that, in the absence of the capacitor $C_{if}$ of the intermediate module, the regulator would be unstable, with a negative phase margin for load capacitances of the order of 1 μF to 10 μF.

Figure 10:
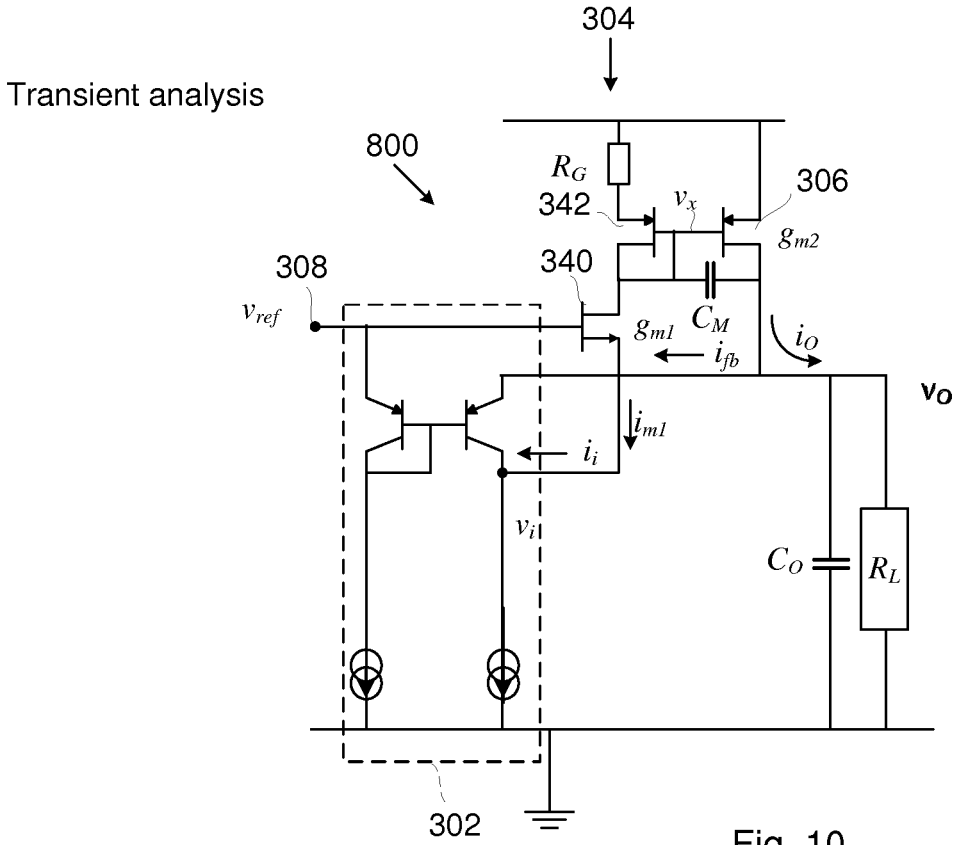
FIG. 10 is a representation of the LDO regulator of FIG. 3 in closed loop configuration but without the frequency compensation module.
Figure 11:
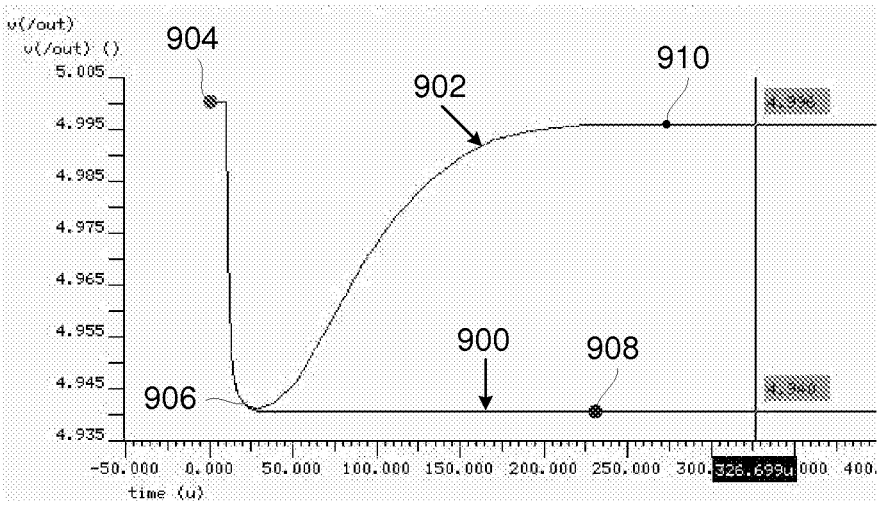
FIG. 11 is a graph of output voltage against time for the LDO regulators of FIGS. 3 and 10, illustrating their comparative transient responses.

FIG. 10 shows a theoretical closed-loop configuration 800 of the regulator of FIG. 4 without the frequency and phase compensation module 312 for the purpose of comparison of the transient response with the complete regulator 300 of FIG. 3. In FIG. 11, the curve 900 shows the response as a function of time of the configuration 500 of FIG. 10 to a step change in load resistance from open-circuit to a finite value conducting a current $i_O$ of 200 mA and the curve 902 shows the comparable response of the complete regulator 300. The transistor 320 and current source 324 carry a substantially constant current of 10 μAs.

For both configurations 300 and 800, at time 0 shown at point 504 where the load is open-circuit, the load current $i_O$ is 0 mAs and the offset between the output voltage $v_O$ and the reference voltage $v_{ref}$ is zero. The feedback current $i_{fb}$ from the node 310 to the modules 302 and 312 is 100 μAs and flows through the transistor 322 and the current source 326 to ground.

When the load assumes its finite value, the load current $i_O$ rises to its maximum value, in this example 200 mAs, and the offset between the output voltage $v_O$ and the reference voltage $v_{ref}$ rises to 60 mV, as shown at point 906 in FIG. 11. In the case of the configuration 800 of FIG. 10, the feedback current $i_{fb}$v from the node 310 to the module 302 is reduced to 10 μAs and is added with a current $i_i$ of 90 μAs from the node 328 of the buffer stage 304 to flow through the current source 326 to ground. Consequently, the voltage difference between the gate ($v_{ref}$) and the source (node 328) of the FET 340 remains reduced and the offset between the output voltage $v_O$ and the reference voltage $V_{ref}$ remains at 60 mV, as shown at 908.

In the case of the configuration 300 of FIG. 3, at the point 906, the feedback current $i_{fb}$ from the node 310 to the module 302 is again reduced to 10 μAs and flows through the transistor 322, being added with a current $i_i$ of 90 μAs from the node 328 of the buffer stage 304 to flow through the current source 326 to ground. A current $i_{lf}$ of 80 μAs also flows through the FET 344, which is biased by the capacitor $C_{lf}$, previously charged by the voltage $v_{ref}$ through the FET 340. Consequently, the voltage difference between the gate ($v_{ref}$) and the source ($v_i$) of the FET 340 increases rapidly and the offset between the output voltage $v_O$ and the reference voltage $v_{ref}$ reduces rapidly from 60 mV to 4 mV at point 910 in FIG. 11, the capacitor $C_{lf}$ progressively discharging due to a current of 10 μAs also flowing through the resistor $R_{lf}$ and the current source 350 to ground.

The invention claimed is:

1. A low drop-out DC voltage regulator comprising:

an output pass element for controlling an output voltage of power supplied from a power supply through the output pass element to a load;

a source of a reference voltage; and a feedback loop for providing to said output pass element a control signal tending to correct error in the output voltage, said feedback loop including a differential module including a differential amplifier responsive to relative values of said output voltage and said reference voltage and an intermediate module driven by said differential module for providing said control signal, the regulator presenting a cut-off frequency at which its regulation gain becomes less than one, said differential amplifier comprising a common base emitter follower circuit including a first transistor and a second transistor, an emitter of the first transistor coupled to said output voltage and an emitter of the second transistor coupled to said reference voltage;

wherein said differential module presents the widest bandwidth of the modules of the regulator and said differential module presents a frequency pole that is higher than said cut-off frequency, and said feedback loop includes a further amplifier element comprising a capacitive element such as to increase gain of said differential module at low frequencies, the low drop-out DC voltage regulator being stable as measured by the phase margin whatever the values of the load resistance and capacitance.

2. A low drop-out DC voltage regulator as claimed in claim 1, wherein said feedback loop presents a gain at high frequencies sufficient to drive the transient output current in said load and a higher gain at low frequencies.

3. A low drop-out DC voltage regulator as claimed in claim 2 wherein said differential amplifier is responsive to relative values of said output voltage and said reference voltage, and said further amplifier element comprises a further transistor having a base connected in common with the bases of said first and second transistor and connected to drive a current amplifier including said capacitive element.

4. A low drop-out DC voltage regulator as claimed in claim 2, wherein said intermediate module comprises the series combination of a first control element driven by said differential module and a second control element connected in a current mirror configuration with said output pass element.

5. A low drop-out DC voltage regulator as claimed in claim 1 wherein said differential amplifier is responsive to relative values of said output voltage and said reference voltage, and said further amplifier element comprises a further transistor having a base connected in common with the bases of said first and second transistors and connected to drive a current amplifier including said capacitive element.

6. A low drop-out DC voltage regulator as claimed in claim 5, wherein said intermediate module comprises the series combination of a first control element driven by said differential module and a second control element connected in a current mirror configuration with said output pass element.

7. A low drop-out DC voltage regulator as claimed in claim 1, wherein said intermediate module comprises a series combination of a first control element driven by said differential module and a second control element connected in a current mirror configuration with said output pass element.

8. A method comprising:

providing a voltage at an output of a voltage regulator, the output voltage determined in response to a control signal received from an intermediate module, the intermediate module responsive to an output of a differential module, the differential module comprising a common base emitter follower circuit including a first transistor and a second transistor, the regulator presenting a cut-off frequency at which its regulation gain becomes less than one;

receiving the output voltage at an emitter of the first transistor; and receiving a reference voltage at an emitter of the second transistor;

wherein the differential module presents the widest bandwidth of the modules of the regulator and presents a frequency pole that is higher than the cut-off frequency, the voltage regulator being stable as measured by the phase margin whatever the values of a load resistance and capacitance at the output of the voltage regulator.

9. The method of claim 8, wherein the differential module and the intermediate module implement a feedback loop, the feedback loop presenting a first gain at high frequencies, the first gain sufficient to drive transient current to a load at the output of the regulator and a second gain higher than the first gain at low frequencies.

10. The method of claim 9, wherein the differential module is responsive to relative values of the output voltage and the reference voltage, and wherein the feedback loop includes a further amplifier element comprising a capacitive element such as to increase gain of the differential module at low frequencies.

11. The method of claim 10, wherein the further amplifier element comprises a further transistor having a base connected in common with the bases of said first and second transistor and connected to drive a current amplifier including the capacitive element.

12. The method of claim 9, wherein said intermediate module comprises a series combination of a first control element driven by the differential module and a second control element connected in a current mirror configuration with the output pass element.

13. The method of claim 8, wherein the differential module and the intermediate module implement a feedback loop, the differential module responsive to relative values of the output voltage and the reference voltage, and wherein the feedback loop includes a further amplifier element comprising a capacitive element such as to increase gain of the differential module at low frequencies.

14. The method of claim 13, wherein the further amplifier element comprises a further transistor having a base connected in common with the bases of the first and second transistors and connected to drive a current amplifier including the capacitive element.

15. The method of claim 13, wherein said intermediate module comprises a series combination of a first control element driven by the differential module and a second control element connected in a current mirror configuration with the output pass element.

16. The method of claim 8, wherein said intermediate module comprises a series combination of a first control element driven by the differential module and a second control element connected in a current mirror configuration with the output pass element.

17. A voltage regulator comprising:

an output pass element for controlling an output voltage of power supplied from a power supply through the output pass element to a load;

a source of a reference voltage; and a feedback loop for providing to said output pass element a control signal tending to correct error in the output voltage, said feedback loop including a differential module including a differential amplifier responsive to relative values of said output voltage and said reference voltage and an intermediate module driven by said differential module for providing said control signal, the regulator presenting a cut-off frequency at which its regulation gain becomes less than one, said differential amplifier comprising a common base emitter follower circuit including a first transistor and a second transistor, an emitter of the first transistor coupled to said output voltage and an emitter of the second transistor coupled to said reference voltage;

wherein said differential module presents the widest bandwidth of the modules of the regulator and said differential module presents a frequency pole that is higher than said cut-off frequency.

18. The voltage regulator of claim 17, wherein said feedback loop presents a gain at high frequencies sufficient to drive the transient output current in said load and a higher gain at low frequencies.

19. The voltage regulator of claim 17, wherein said feedback loop includes a further amplifier element comprising a capacitive element such as to increase gain of said differential module at low frequencies, the low drop-out DC voltage regulator being stable as measured by the phase margin whatever the values of the load resistance and capacitance.

20. The voltage regulator of claim 19, wherein said differential amplifier is responsive to relative values of said output voltage and said reference voltage, and said further amplifier element comprises a further transistor having a base connected in common with the bases of said first and second transistors and connected to drive a current amplifier including said capacitive element.

* * * * *